US010494756B2

(12) United States Patent
Beers et al.

(10) Patent No.: US 10,494,756 B2
(45) Date of Patent: Dec. 3, 2019

(54) DRYER APPLIANCES INCLUDING AN AIR CIRCULATION DUCT

(71) Applicants: Haier US Appliance Solutions, Inc., Wilmington, DE (US); UT-Battelle, LLC, Oak Ridge, TN (US)

(72) Inventors: David G. Beers, Elizabeth, IN (US); David Scott Dunn, Smithfield, KY (US); Kyle R. Gluesenkamp, Knoxville, TN (US); Philip R. Boudreaux, Knoxville, TN (US); Bo Shen, Oakridge, TN (US)

(73) Assignees: Haier US Appliance Solutions, Inc., Wilmington, DE (US); UT-Battelle, LLC, Oak Ridge, TN (US)

( * ) Notice: Subject to any disclaimer, the term of this patent is extended or adjusted under 35 U.S.C. 154(b) by 73 days.

(21) Appl. No.: 15/814,474

(22) Filed: Nov. 16, 2017

(65) Prior Publication Data

US 2019/0145043 A1 May 16, 2019

(51) Int. Cl.

| | |
|---|---|
| ***D06F 58/20*** | (2006.01) |
| ***D06F 58/02*** | (2006.01) |
| ***D06F 58/10*** | (2006.01) |
| ***D06F 58/28*** | (2006.01) |

(52) U.S. Cl.

CPC ..... *D06F 58/206* (2013.01); *D06F 58/02* (2013.01); *D06F 58/10* (2013.01); *D06F 2058/287* (2013.01)

(58) Field of Classification Search

CPC ..... D06F 58/206; D06F 58/02; D06F 58/10; D06F 2058/287

USPC ..... 34/595

See application file for complete search history.

(56) References Cited

U.S. PATENT DOCUMENTS

| | | | | |
|---|---|---|---|---|
| 3,805,404 | A * | 4/1974 | Gould | D06F 58/04 34/596 |
| 7,191,543 | B2 * | 3/2007 | Yakumaru | D06F 58/206 34/77 |
| 8,347,520 | B2 | 1/2013 | Kuwabara | |
| 9,097,462 | B2 * | 8/2015 | Lorenc | D06F 58/206 |
| 9,290,885 | B2 * | 3/2016 | Kim | D06F 58/26 |
| 9,834,882 | B2 * | 12/2017 | Patil | F26B 21/086 |

(Continued)

FOREIGN PATENT DOCUMENTS

| | | | | |
|---|---|---|---|---|
| EP | 1614976 | A4 * | 8/2006 | D06F 58/206 |
| EP | 1550829 | A4 * | 12/2006 | D06F 58/206 |

(Continued)

*Primary Examiner* — Stephen M Gravini

(74) *Attorney, Agent, or Firm* — Dority & Manning, P.A.

(57) ABSTRACT

A dryer appliance including an air circulation duct is provided herein. The dryer appliance may also include a cabinet, a drum, an air handler, and a heat exchange section. The air circulation duct may define a recirculation loop with the drum. The air circulation duct may define a drum air inlet upstream from the drum and a drum air outlet downstream from the drum. The air circulation duct may further define a predetermined leakage port in fluid communication between the recirculation loop and the interior volume of the cabinet. The air handler may be disposed along the air circulation duct in fluid communication between the drum air outlet and the drum air inlet. The heat exchange section may be disposed along the air circulation duct in thermal communication with air within the recirculation loop.

18 Claims, 5 Drawing Sheets

(56) References Cited

U.S. PATENT DOCUMENTS

| | | | | |
|---|---|---|---|---|
| 9,845,567 | B2 * | 12/2017 | Contarini | D06F 58/24 |
| 9,951,462 | B2 * | 4/2018 | Scheckelhoff | D06F 39/088 |
| 10,006,721 | B2 * | 6/2018 | Kohavi | F16L 53/00 |
| 10,041,860 | B2 * | 8/2018 | Rahman | G01K 13/02 |
| 2005/0246920 | A1 | 11/2005 | Yabuuchi et al. | |
| 2015/0259847 | A1 * | 9/2015 | Kohavi | F16L 53/00 34/468 |

FOREIGN PATENT DOCUMENTS

| | | | | |
|---|---|---|---|---|
| EP | 3109358 | B1 * | 8/2018 | D06F 58/04 |
| JP | 2009090050 | A | 4/2009 | |
| WO | WO2014030332 | A1 | 2/2014 | |

* cited by examiner

DRYER APPLIANCES INCLUDING AN AIR CIRCULATION DUCT

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

THE NAMES OF THE PARTIES TO A JOINT RESEARCH AGREEMENT

This invention was made under Corporate Research and Development Agreement (CRADA) NFE-12-04273 between Haier US Appliance Solutions, Inc. and UT-Battelle, LLC.

FIELD OF THE INVENTION

The present subject matter relates generally to dryer appliances, and more particularly to dryer appliances that utilize an air circulation duct.

BACKGROUND OF THE INVENTION

A conventional appliance for drying articles such as a clothes dryer (or laundry dryer) for drying clothing articles typically includes a cabinet having a rotating drum for tumbling clothes and laundry articles therein. One or more heating elements heat air prior to the air entering the drum, and the warm air is circulated through the drum as the clothes are tumbled to remove moisture from laundry articles in the drum. Gas or electric heating elements may be used to heat the air that is circulated through the drum.

In a known operation, ambient air from outside is drawn into the cabinet and passed through the heater before being fed to the drum. Moisture from the clothing is transferred to the air passing through the drum. Typically, this moisture laden air is then transported away from the dryer by, for example, a duct leading outside of the structure or room where the dryer is placed. The exhausted air removes moisture from the dryer and the clothes are dried as the process is continued by drawing in more ambient air.

Unfortunately, for the conventional dryer described above, the exhausted air is still relatively warm while the ambient air drawn into the dryer must be heated. This process is relatively inefficient because heat energy in the exhausted air is lost and additional energy must be provided to heat more ambient air. More specifically, the ambient air drawn into the dryer is heated to promote the liberation of the moisture out of the laundry. This air, containing moisture from the laundry, is then exhausted into the environment along with much of the heat energy that was used to raise its temperature from ambient conditions.

One alternative to a conventional dryer as described above is a heat pump dryer. More specifically, a heat pump dryer uses a refrigerant cycle to both provide hot air to the dryer and to condense water vapor in air coming from the dryer. Since the moisture content in the air from the dryer is reduced by condensation over the evaporator, this same air can be reheated again using the condenser and then passed through the dryer again to remove more moisture. Moreover, since the air is recycled through the dryer in a closed loop rather than being ejected to the environment, the heat pump dryer can be more efficient to operate than the traditional dryer described above. In addition, the heating source provided by the sealed refrigerant system of a heat pump dryer can be more efficient than a gas or electric heater implemented in the conventional dryer.

In typical heat pump dryer systems, the closed loop of air is substantially sealed from the ambient environment (e.g., an internal volume defined by the cabinet of the dryer appliance). During operation of a typical heat pump dryer, as air circulates, the temperature of the air within the sealed loop increases. Similarly, the thermal load to the sealed refrigerant system increases. In some instances, the compressor of the sealed refrigeration system may be unable to handle the increased thermal load and overheat (e.g., at a compressor portion) due to the compressor discharge temperature exceeding an upper operating limit.

In addition to potential issues with overheating, typical heat pump dryers require significantly higher cycle times when compared to other conventional systems. In other words, the time required to dry a given load will often be much higher for a heat pump dryer when compared to a conventional gas or electric dryer appliance.

Accordingly, a dryer appliance having improved efficiency over conventional gas or electric dryers, as well as typical heat pump dryers would be advantageous. In particular, a dryer appliance that further reduced cycle times over typical heat pump dryers would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance is provided. The dryer appliance may include a cabinet, a drum, an air circulation duct, an air handler, and a heat exchange section. The cabinet may define an interior volume. The drum may be rotatably mounted within the interior volume of the cabinet. The drum may define a space for the receipt of clothes for drying. The air circulation duct may define a recirculation loop with the drum. The air circulation duct may define a drum air inlet upstream from the drum and a drum air outlet downstream from the drum. The air circulation duct may further define a predetermined leakage port in fluid communication between the recirculation loop and the interior volume of the cabinet. The air handler may be disposed along the air circulation duct in fluid communication between the drum air outlet and the drum air inlet. The heat exchange section may be disposed along the air circulation duct in thermal communication with air within the recirculation loop.

In another aspect of the present disclosure, a dryer appliance is provided. The dryer appliance may include a cabinet, a drum, an air circulation duct, an air handler, a heat exchange section, and a sealed refrigeration circuit. The cabinet may define an interior volume. The drum may be rotatably mounted within the interior volume of the cabinet. The drum may define a space for the receipt of clothes for drying. The air circulation duct may define a recirculation loop with the drum. The air circulation duct may define a drum air inlet upstream from the drum and a drum air outlet downstream from the drum. The air circulation duct may further define a predetermined leakage port in fluid communication between the recirculation loop and the interior volume of the cabinet. The sealed refrigeration circuit may be mounted within the interior volume of the cabinet. The sealed refrigeration circuit may include a compressor and a condenser. The compressor may motivate a refrigerant therethrough. The condenser may condense the refrigerant from the compressor. Moreover, the heat exchange section may provide the condenser along the air circulation duct to transfer heat to air within the recirculation loop.

In yet another aspect of the present disclosure, a dryer appliance is provided. The dryer appliance may include a cabinet, a drum, an air circulation duct, an air handler, and a heat exchange section. The cabinet may define an interior volume. The drum may be rotatably mounted within the interior volume of the cabinet. The drum may define a space for the receipt of clothes for drying. The air circulation duct may define a recirculation loop with the drum. The air circulation duct may define a drum air inlet upstream from the drum and a drum air outlet downstream from the drum. The air circulation duct may further define a predetermined leakage port in fluid communication with the recirculation loop. The air handler may be disposed along the air circulation duct in fluid communication between the drum air outlet and the drum air inlet. The heat exchange section may be disposed along the air circulation duct in thermal communication with air within the recirculation loop. Moreover, the predetermined leakage port may define a flow coefficient ratio between 5 and 20 based on a flow rate and a pressure difference thereacross.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
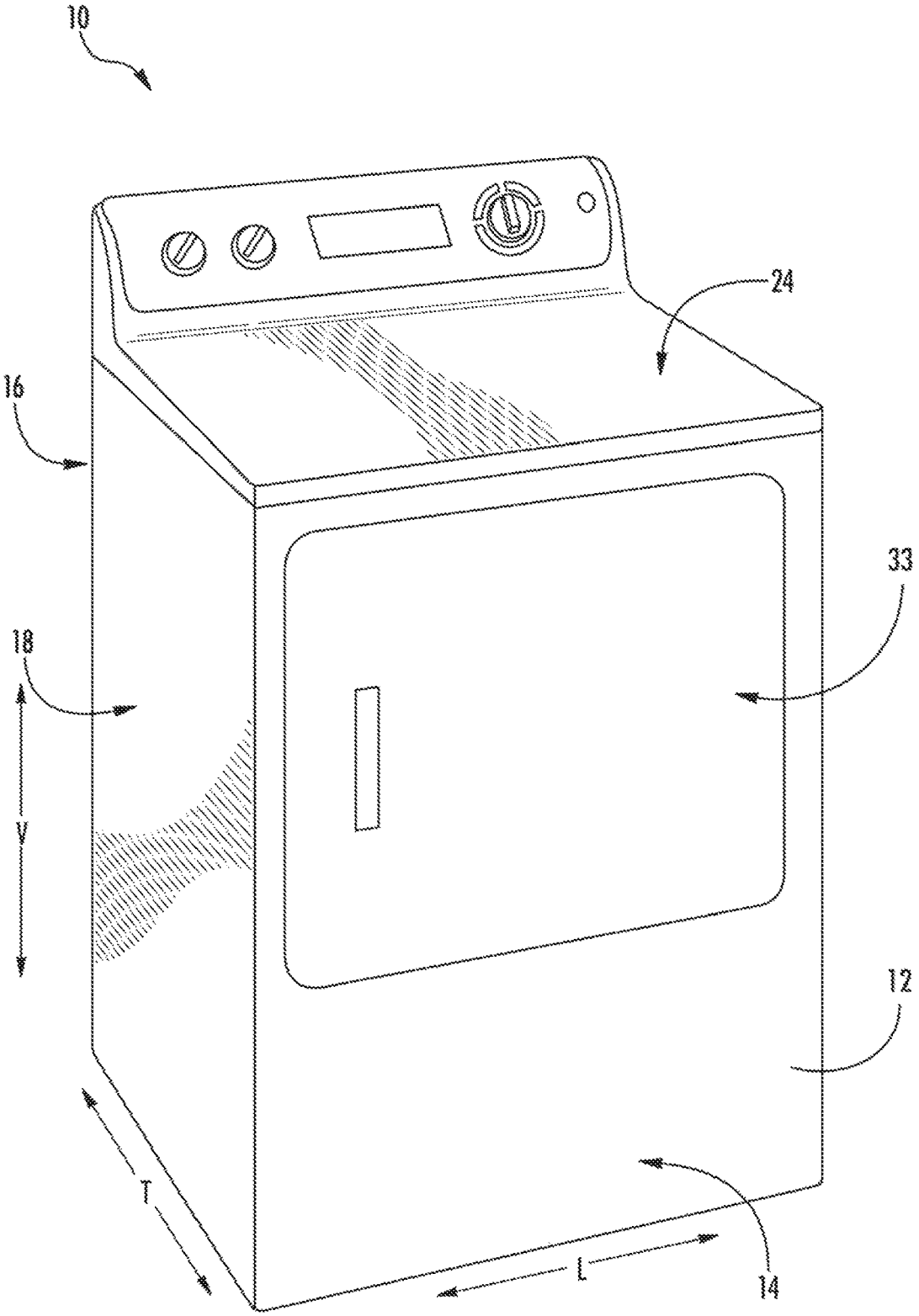
FIG. 1 provides a perspective view of a dryer appliance in accordance with exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
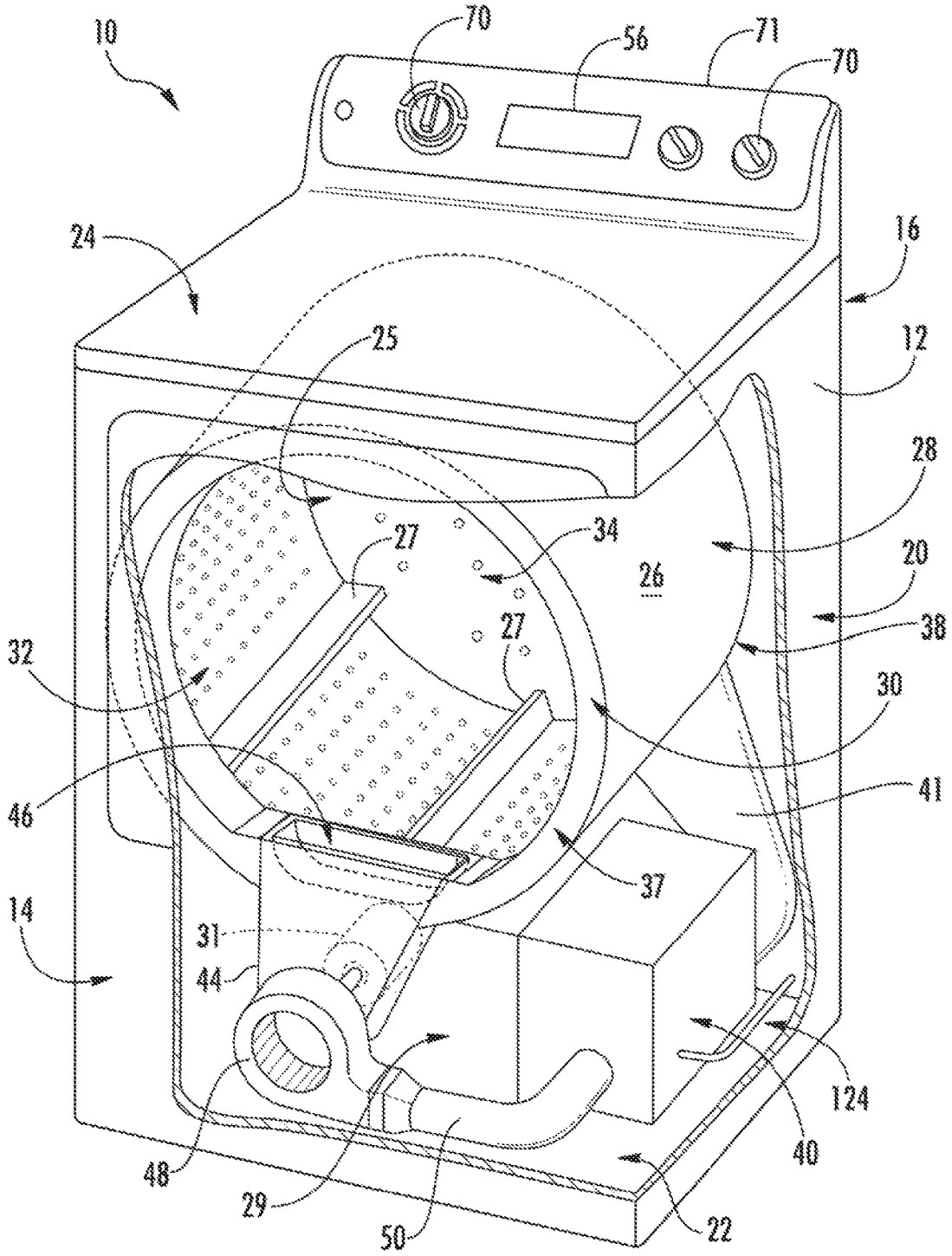
FIG. 2 provides a perspective view of the example dryer appliance of FIG. 1 with portions of a cabinet of the dryer appliance removed to reveal certain components of the dryer appliance.

Turning now to the figures, FIG. 1 provides dryer appliance 10 according to exemplary embodiments of the present disclosure. FIG. 2 provides another perspective view of dryer appliance 10 with a portion of a cabinet or housing 12 of dryer appliance 10 removed in order to show certain components of dryer appliance 10. Dryer appliance 10 generally defines a vertical direction V, a lateral direction L, and a transverse direction T, each of which is mutually perpendicular, such that an orthogonal coordinate system is defined. While described in the context of a specific embodiment of dryer appliance 10, using the teachings disclosed herein, it will be understood that dryer appliance 10 is provided by way of example only. Other dryer appliances having different appearances and different features may also be utilized with the present subject matter as well.

Cabinet 12 includes a front panel 14, a rear panel 16, a pair of side panels 18 and 20 spaced apart from each other by front and rear panels 14 and 16, a bottom panel 22, and a top cover 24. Within cabinet 12, an interior volume 29 is defined. A drum or container 26 mounted for rotation about a substantially horizontal axis within the interior volume 29. Drum 26 defines a chamber 25 for receipt of articles of clothing for tumbling and/or drying. Drum 26 extends between a front portion 37 and a back portion 38. Drum 26 also includes a back or rear wall 34, e.g., at back portion 38 of drum 26. A supply duct 41 may be mounted to rear wall 34 and receives heated air that has been heated by a heating assembly or system 40.

As used herein, the term "clothing" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

A motor 31 is provided in some embodiments to rotate drum 26 about the horizontal axis, e.g., via a pulley and a belt (not pictured). Drum 26 is generally cylindrical in shape, having an outer cylindrical wall 28 and a front flange or wall 30 that defines an opening 32 of drum 26, e.g., at front portion 37 of drum 26, for loading and unloading of articles into and out of chamber 25 of drum 26. A plurality of lifters or baffles 27 are provided within chamber 25 of drum 26 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Drum 26 includes a rear wall 34 rotatably supported within main housing 12 by a suitable fixed bearing. Rear wall 34 can be fixed or can be rotatable. Rear wall 34 may include, for instance, a plurality of holes that receive hot air that has been heated by a heat pump or refrigerant based heating system 40—to be described further below. Moisture laden, heated air is drawn from drum 26 by an air handler, such as blower fan 48, which generates a negative air pressure within drum. The air passes through a duct 44 enclosing screen filter 46, which traps lint particles. As the air passes from blower fan 48, it enters a duct 50 and then is passed into heating system 40. Heated air (with a lower moisture content than was received from drum 26), exits heating system 40 and returns to drum 26 by duct 41. After the clothing articles have been dried, they are removed from the drum 26 via opening 32. A door 33 provides for closing or accessing drum 26 through opening 32.

In some embodiments, one or more selector inputs 70, such as knobs, buttons, touchscreen interfaces, etc., may be provided or mounted on a cabinet 12 (e.g., on a backsplash 71) and are in operable communication (e.g., electrically coupled or coupled through a wireless network band) with a processing device or controller 56. Controller 56 may also be provided in operable communication with motor 31, blower 48, or heating assembly 40. In turn, signals generated in controller 56 direct operation of motor 31, blower 48, or heating assembly 40 in response to the position of inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations.

Figure 3:
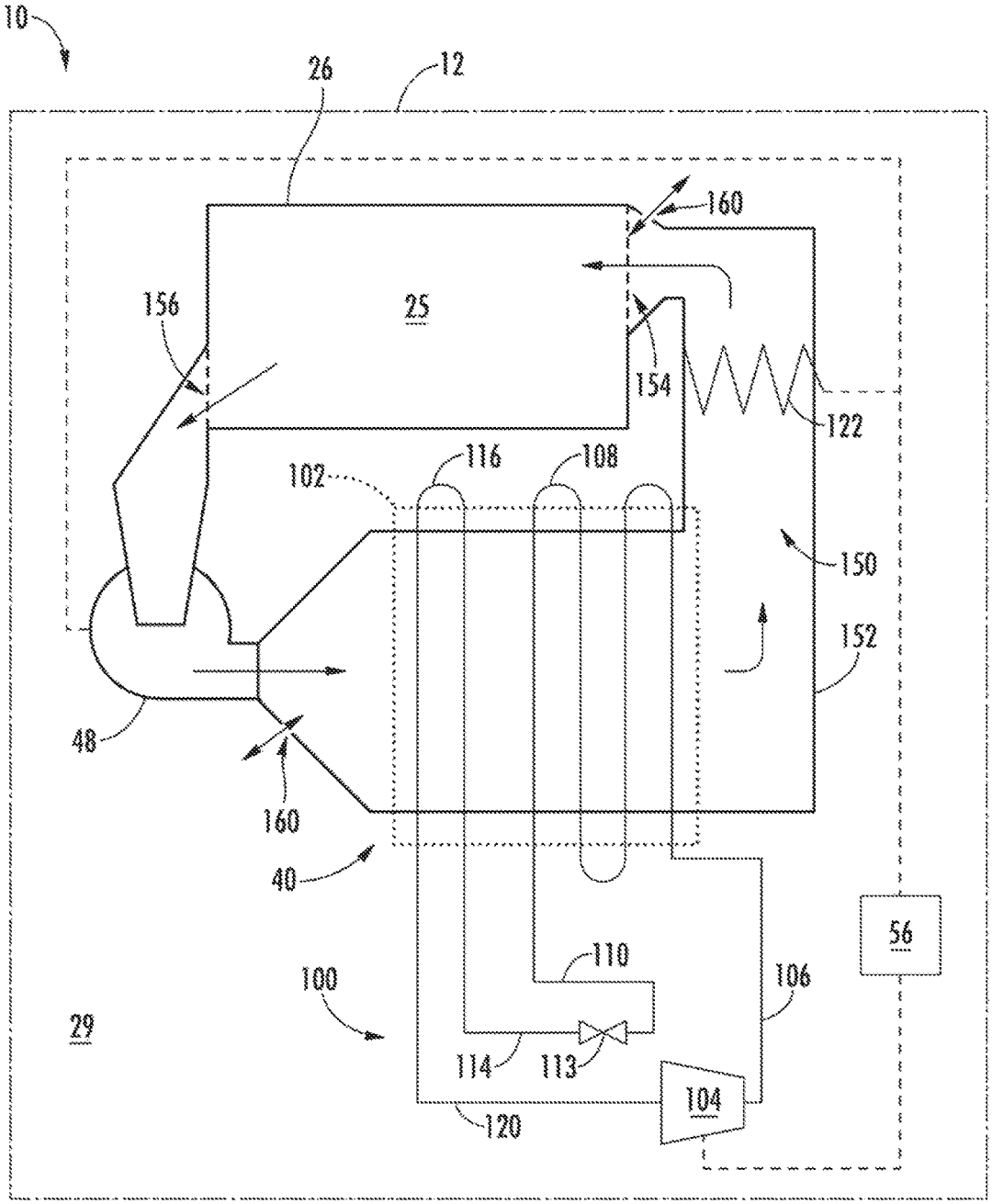
FIG. 3 provides a schematic view of a dryer appliance according to certain exemplary embodiments of the present disclosure.

Turning now to FIG. 3, a schematic view of exemplary embodiments of dryer appliance 10 is provided. It is understood that, except as otherwise indicted, dryer appliance 10 in FIG. 3 may include some or all of the features described above with respect to FIGS. 1 and 2.

As shown, dryer appliance 10 includes an air circulation duct 152 (e.g., which may include ducts 44, 50, or 41—FIG. 2). Generally, air circulation duct 152 defines a recirculation loop 150 with drum 26. In particular, air circulation duct 152 may define a drum air inlet 154 upstream from the drum 26 (e.g., at rear wall 34—FIG. 2) and a drum air outlet 156 downstream from drum 26. Air may thus flow downstream along a sequential path of recirculation loop 150. Specifically, air may flow from chamber 25 to air circulation duct 152 through air outlet 156, and from air circulation duct 152 to chamber 25 through air inlet 154.

During stable operating conditions, moisture laden air, received from drum 26 (e.g., chamber 25) is caused to flow across a heat exchange section 102 in thermal communication with air through the recirculation loop 150. In particular, moisture laden air may flow across at least a portion of a sealed refrigeration circuit 100. As shown, air from air inlet 154 may flow through blower 48 and across an evaporator 116. As air passes across evaporator 116, the temperature of the air is reduced through heat exchange with refrigerant that is vaporized within, for example, coils or tubing of evaporator 116. This vaporization process absorbs both the sensible and the latent heat from the moisture laden air—thereby reducing its temperature. As a result, moisture in the air is condensed and may be drained from heating assembly (e.g., using line 124—FIG. 2).

Air passing over evaporator 116 becomes drier and cooler than when it was received from drum 26 of dryer appliance 10. As shown, the air from evaporator 116 is subsequently caused to flow across a condenser 108 (e.g., across coils or tubing), which condenses refrigerant therein. The refrigerant enters condenser 108 in a gaseous state at a relatively high temperature compared to the air from evaporator 116. As a result, heat energy is transferred to the air within recirculation loop 150—thereby elevating its temperature and providing warm air for resupply to the drum 26 of dryer appliance 10. Because the same air is recycled through drum 26 and heating assembly 40, dryer appliance 10 can have a much greater efficiency than traditional clothes dryers where warm, moisture laden air is exhausted to the environment.

As shown, some embodiments of heating assembly 40 include a compressor 104 that pressurizes refrigerant (i.e., increases the pressure of the refrigerant) supplied by suction line 120 and generally motivates refrigerant through the sealed refrigeration circuit 100. Compressor 104 may be in operable communication with controller 56 and is generally designed to pressurize a gas phase refrigerant. Accordingly, in order to avoid damage, refrigerant in suction line 120 is supplied in a gas phase. The pressurization of the refrigerant with compressor 104 increases the temperature of the refrigerant (e.g., as directed by controller 56). Accordingly, by line 106, the compressed refrigerant is fed to condenser 108. As relatively cool air from the evaporator 116 is passed over the condenser 108, the refrigerant is cooled and its temperature is lowered as heat is transferred to the air for supply to drum 26.

Upon exiting condenser 108, the refrigerant is fed by line 110 to an expansion device 113. Although only one expansion device 113 is shown, such is by way of example only. It is understood that multiple such devices may be used. Expansion device 113 lowers the pressure of the refrigerant and controls the amount of refrigerant that is allowed to enter the evaporator 116 by line 114. Importantly, the flow of liquid refrigerant into evaporator 116 is limited by expansion device 113 in order to keep the pressure low and allow expansion of the refrigerant back into the gas phase in the evaporator 116. The evaporation of the refrigerant in the evaporator 116 converts the refrigerant from its liquid-dominated phase to a gas phase while cooling the air from drum 26. The process is repeated as air is circulated through drum 26 and between evaporator 116 and condenser 108 while the refrigerant is cycled through the sealed refrigeration circuit 100, as described above.

In some embodiments, a heating element 122, such as an electrically resistive element or wire, is mounted along air recirculation loop 150 (e.g., on or within air circulation duct 152). For instance, heating element 122 may be disposed downstream from evaporator 116 or condenser 108 and upstream from drum 26.

During certain drying operations, heating element 122 may thus be activated (e.g., as directed by controller 56) to further heat air within recirculation loop 150 before such air is directed to chamber 25. In some such embodiments, a temperature sensing element 162 (see FIG. 5) that measures the temperature of air within air circulation duct 152 is in operable communication with controller 56. Using measurement signals received from temperature sensing element 162, controller 56 can determine when heating assembly 40 has reached stable operating conditions or the desired operating state conditions. More particularly, controller 56 can monitor temperature sensing element 162 and allow heating element 122 to add energy into heating assembly 40 until a predetermined temperature set point is reached (e.g., as determined using measurement signals from temperature sensing element 162). Upon reaching the set point, processing device can deactivate or otherwise regulate heating element 122.

Dryer appliance 10 may be provided with an option whereby the user can elect to by-pass the activation or operation of heating element 122 (e.g., as selected at user inputs 70). More particularly, the use of heating element 122 can reduce the overall drying cycle time but may lead to increased energy usage depending upon, for example, the size of the load of articles in drum 26. If, for a particular load of articles, the user does not object to the longer cycle time, the user can elect to by-pass operating of the heating element 122. In some such embodiments, controller 56 is configured to deactivate heating element 122 based on one or more predetermined conditions, such as a user selection at user inputs 70 or as instructed from an outside signal (e.g., a signal from a smart grid enabled appliance). Similarly, the user could select reactivation of heating element 122 if a shorter cycle time is preferred.

In some embodiments, one or more predetermined leakage ports 160 are defined along recirculation loop 150. Such predetermined leakage ports 160 may generally permit air to pass between recirculation loop 150 and an area surrounding recirculation loop 150, such as the interior volume 29. As noted above, interior volume 29 is generally defined by cabinet 12 and encloses drum 26, as well as air circulation duct 152. In some embodiments, air passing through predetermined leakage ports 160 (e.g., from recirculation loop 150 to interior volume 29 or from interior volume 29 to recirculation loop 150) may thus remain within dryer appliance 10 without escaping immediately to the greater ambient environment about dryer appliance 10.

The size or shape of each predetermined leakage port 160 may be predesigned to include any suitable size or shape. Moreover, each predetermined leakage port 160 may be provided as (e.g., be defined as) a single continuous void or, alternatively, a plurality of discrete holes or voids. In embodiments wherein multiple predetermined leakage ports 160 are defined, such as the exemplary embodiments of FIG. 3, each predetermined leakage port 160 may be defined as an identical or, alternatively, unique size or shape.

Generally, each predetermined leakage port 160 is defined at a specific predetermined location along recirculation loop 150. In particular, a predetermined leakage port 160 is defined, at least in part, by air circulation duct 152 along the flow path apart from chamber 25 (e.g., between air inlet 154 and air outlet 156). In turn, predetermined leakage port 160 may limit excessive heat accumulation within air recirculation loop 150 (as well as the thermal load at compressor 104) without requiring further powered or pressure-adjusting features.

In exemplary embodiments, a predetermined leakage port 160 is defined along recirculation loop 150 between the blower 48 and the heat exchange section 102. For instance, predetermined leakage port 160 may be defined at a fixed connection joint or shroud that connects blower 48 to a segment of air circulation duct 152. Alternatively, predetermined leakage port 160 may be defined directly through a sidewall portion of air circulation duct 152 adjacent to blower 48 between blower 48 and evaporator 116 along the air recirculation loop 150. As shown, the predetermined leakage port 160 may be positioned downstream from blower 48 and upstream from evaporator 116 and condenser 108. Moreover, during use, the predetermined leakage port 160 may be subject to a positive air pressure generated at blower 48. At least a portion of the air from blower 48 and air recirculation loop 150 may be exhausted directly (e.g., without an intermediary duct or conduit) to interior volume 29.

In additional or alternative exemplary embodiments, a predetermined leakage port 160 is defined along recirculation loop 150 between the heat exchange section 102 and the drum air inlet 154. For instance, predetermined leakage port 160 may be defined at a fixed or rotating connection joint or shroud that connects a segment of air circulation duct 152 to drum 26 (e.g., at rear wall 34—FIG. 2). Alternatively, predetermined leakage port 160 may be defined directly through a sidewall portion of air circulation duct 152 adjacent to drum 26 between condenser 108 and air inlet 154. As shown, the predetermined leakage port 160 may be positioned downstream from evaporator 116 and condenser 108, as well as upstream from chamber 25. Moreover, during use, the predetermined leakage port 160 may be subject to a negative air pressure generated at blower 48. At least a portion of the air from interior volume 29 may be introduced directly (e.g., without an intermediary duct or conduit) to air recirculation loop 150.

When assembled, each predetermined leakage port 160 defines a specific flow coefficient ratio ($C_v$). Generally, the predetermined coefficient ratio is understood to be based on the flow rate of air (e.g., through air recirculation loop 150) and the pressure difference (e.g., pressure drop) at the location of the corresponding predetermined leakage port 160. In particular, may be represented as $$C_v=[Q/\sqrt{(p)}];$$

wherein $C_v$ is the flow coefficient ratio of a corresponding predetermined leakage port 160;

wherein Q is the flow rate of air (e.g., in cubic feet per minute); and wherein p is the pressure differential across the predetermined leakage port 160.

In some embodiments, a predetermined leakage port 160 is configured (e.g., sized or shaped) to define a flow coefficient ratio (i.e., a specific flow coefficient ratio—$C_v$ that is between 5 and 20. In specific embodiments, predetermined leakage port 160 is configured (e.g., sized or shaped) to define a flow coefficient ratio that is 10.

Advantageously, the presence of the described one or more predetermined leakage ports 160 may improve both dryer efficacy (e.g., absolute cycle time required for a given load of laundry) and efficiency (e.g., energy required for the given load). Air at a relatively high humidity (e.g., when compared to the entire air recirculation loop 150) and relatively cool temperature may be exchanged, thereby mitigating the thermal load at the compressor 104. Moreover, the exchange may occur without the use of additional features or an increased energy draw by dryer appliance 10.

Figure 4:
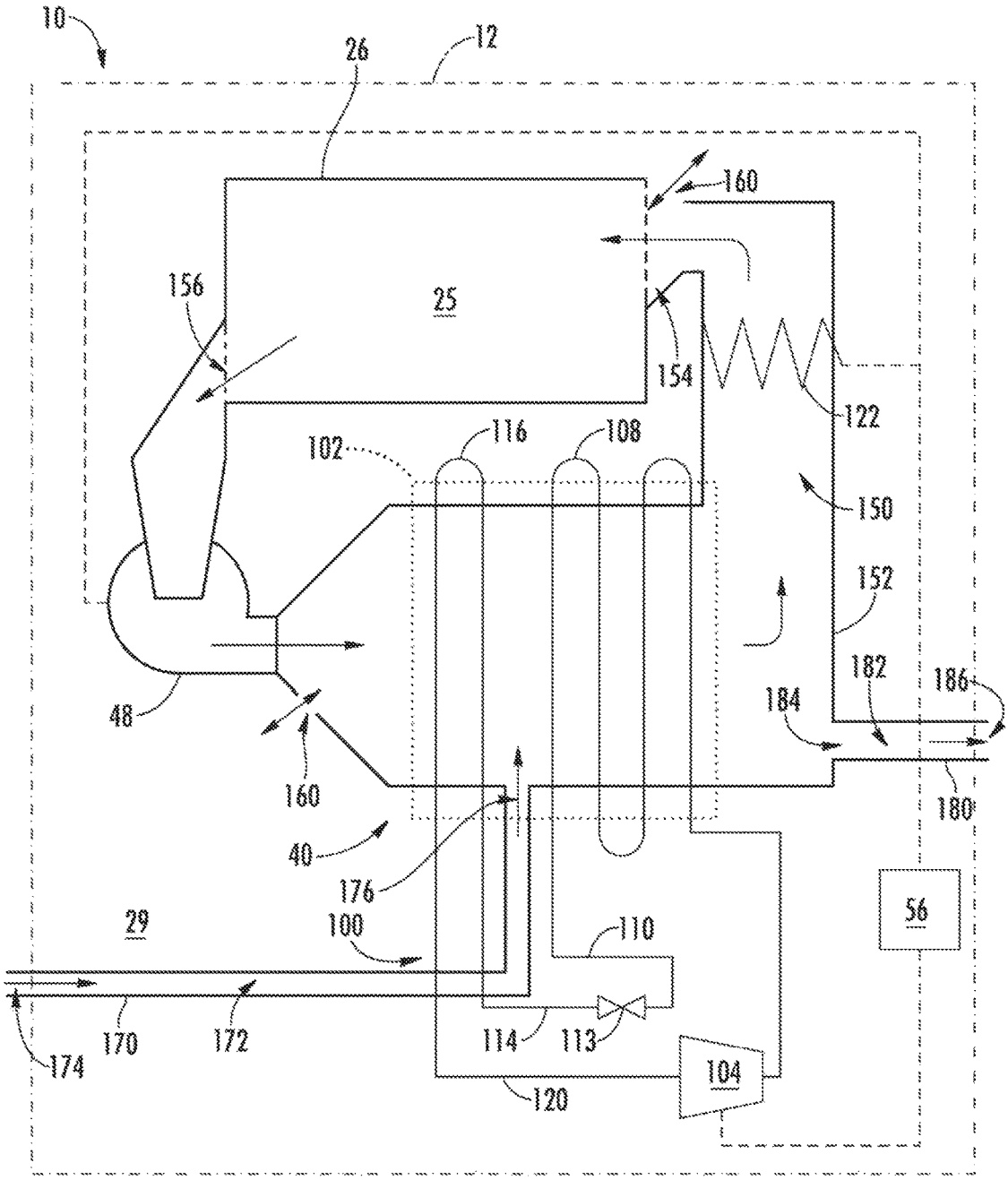
FIG. 4 provides a schematic view of a dryer appliance according to further exemplary embodiments of the present disclosure.

Turning now to FIG. 4, a schematic view of further exemplary embodiments of dryer appliance 10 is provided. It is understood that, except as otherwise indicated, dryer appliance 10 in FIG. 4 may include some or all of the features described above with respect to FIGS. 1 and 3. For instance, as shown in FIG. 4, some embodiments of dryer appliance 10 include one or more ventilation ducts 170, 180 that extend from air circulation duct 152 in fluid communication with recirculation loop 150. Along with fluid recirculation loop 150, each ventilation duct 170, 180 may be in fluid communication with one or more area outside of dryer appliance 10. In turn, each ventilation duct 170, 180 extends through cabinet 12 and may permit further adjustments (e.g., to temperature or humidity) of air within air recirculation loop 150. Although absent from FIG. 4, it is understood that some embodiments may include one or more fans or valves mounted along or in communication with a ventilation duct 170, 180 (e.g., to motivate or control air therethrough). Moreover, although exemplary flow directions are described below with respect to ventilation ducts 170, 180, it is understood that one or both of ducts 170, 180 may permit bidirectional air flow therethrough in additional or alternative embodiments.

In some embodiments, an intake ventilation duct 170 extends through cabinet 12 to supply intake air to a portion of air recirculation loop 150. As shown, intake ventilation duct 170 may thus define a passage 172 extending between an air entrance 174 and an air exit 176. Air entrance 174 is generally positioned at or outside of cabinet 12 to receive intake air, while air exit 176 is generally positioned on (e.g., in direct contact or indirect contact through a mated fitting) air circulation duct 152 to direct the intake air to recirculation loop 150. In certain embodiments, air exit 176 is positioned along air recirculation loop 150 between evaporator 116 and condenser 108 (e.g., downstream from evaporator 116 and upstream from condenser 108). Intake air may thus be conveyed from an area outside of cabinet 12 and to condenser 108, where the intake air may further mix with air previously directed across evaporator 116.

In additional or alternative embodiments, an exhaust ventilation duct 180 extends through cabinet 12 to discharge exhaust air from a portion of air recirculation loop 150. As shown, exhaust ventilation duct 180 may thus define a passage 182 extending between an air entrance 184 and an air exit 186. Air exit 186 is generally positioned at or outside of cabinet 12 to expel exhaust air, while air entrance 184 is generally positioned on (e.g., in direct contact or indirect contact through a mated fitting) air circulation duct 152 to direct the exhaust air to exhaust ventilation duct 180. In certain embodiments, air entrance 184 is positioned along air recirculation loop 150 between condenser 108 and chamber 25 (e.g., downstream from condenser 108 and upstream from chamber 25). Exhaust air may thus be conveyed from downstream from condenser 108 to an area outside of cabinet 12.

Figure 5:
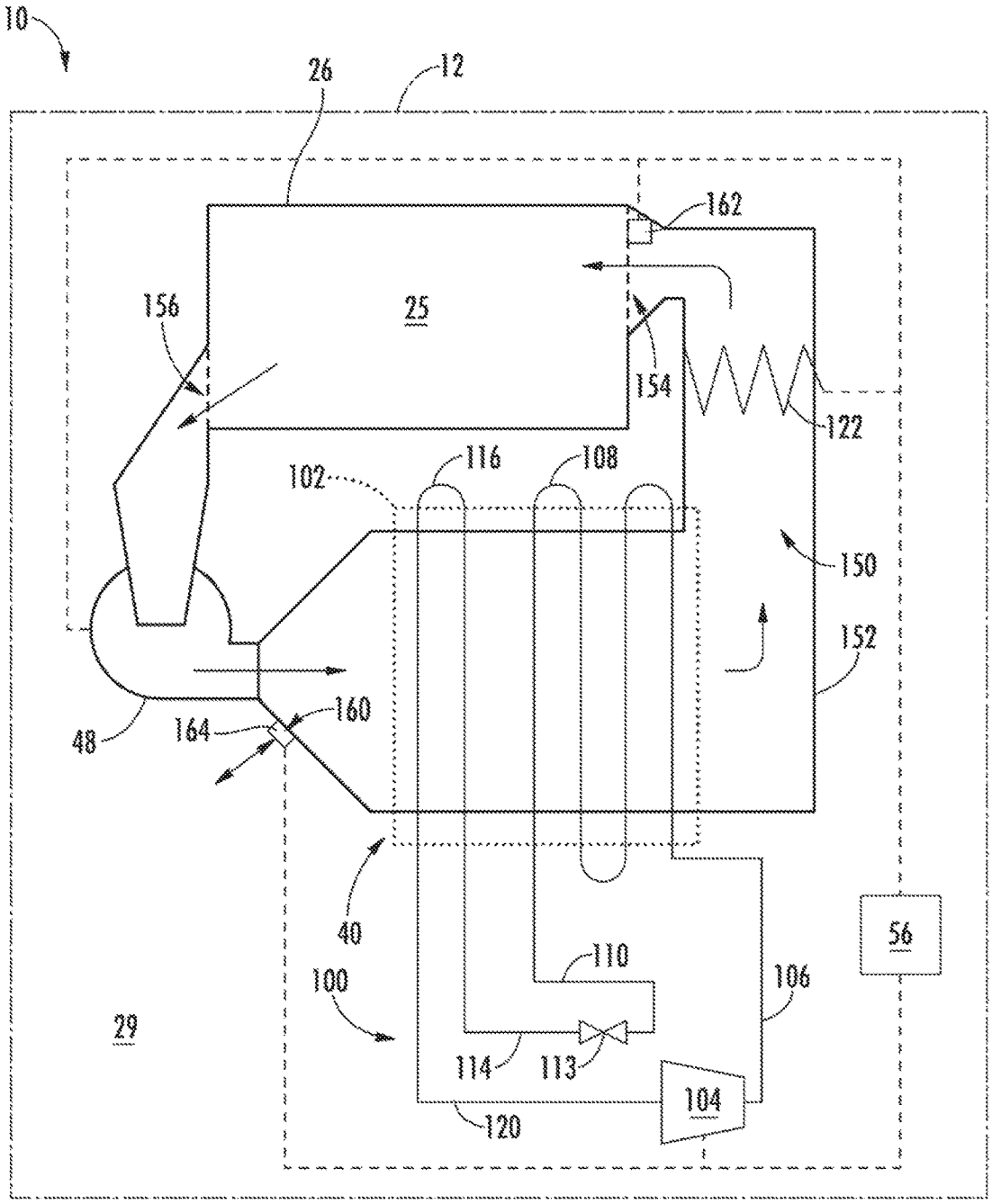
FIG. 5 provides a schematic view of a dryer appliance according to still further exemplary embodiments of the present disclosure.

Turning now to FIG. 5, a schematic view of still further exemplary embodiments of dryer appliance 10 is provided. It is understood that, except as otherwise indicated, dryer appliance 10 in FIG. 5 may include some or all of the features described above with respect to FIGS. 1 and 4. For instance, as shown in FIG. 5, some embodiments of dryer appliance 10 include a leakage valve 164 in fluid communication with a corresponding predetermined leakage port 160. Generally, leakage valve 164 is configured to selectively limit a flow of air between the air recirculation loop 150 and the interior volume 29. In particular, leakage valve 164 may be provided as any suitable air valve, such as a solenoid control valve, flapper valve, actuated damper, gate valve, etc. Actuation may be active (e.g., electronically-controlled by controller 56) or passive (e.g., as controlled by a wax thermostat or other passive structure). When assembled, leakage valve 164 may thus be mounted within or across predetermined leakage port 160 to selectively restrict or block the flow of air therethrough.

In additional or alternative embodiments, a temperature sensing element 162 is mounted along recirculation loop 150 (e.g., on or within air circulation duct 152). For instance, temperature sensing element 162 may be positioned adjacent to drum 26 at air inlet 154. During use, temperature sensing element 162 may thus detect the temperature of air entering chamber 25.

In certain embodiments, activation (e.g., opening or closing) of leakage valve 164 is based on a temperature detected at temperature sensing element 162. As an example, temperature sensing element 162 may be provided as a variable temperature sensor. In some such embodiments, temperature sensor 162 and leakage valve 164 are both operably coupled to controller 56. In turn, controller 56 may be configured to direct air restriction through the leakage valve 164 based on a temperature signal received from the temperature sensor 162. For instance, if the detected temperature exceeds a predetermined threshold, controller 56 may direct leakage valve 164 to open or otherwise increase the volume of air directed through predetermined leakage port 160. Optionally, multiple predetermined thresholds may be provided (e.g., within the controller 56) to further vary the flow of air through leakage valve 164. As another example, temperature sensing element 162 may be provided as a passive temperature switch, such as a normally-closed bimetallic switch electrically coupled to leakage valve 164. In some such embodiments, when the temperature at passive temperature switch sensor 162 exceeds a predetermined threshold, passive temperature switch opens and a current to leakage valve 164 is halted, thereby directing leakage valve 164 to permit air through predetermined leakage valve 164.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet defining an interior volume;

a drum rotatably mounted within the interior volume of the cabinet, the drum defining a space for receipt of clothes for drying;

an air circulation duct defining a recirculation loop with the drum, the air circulation duct defining a drum air inlet upstream from the drum and a drum air outlet downstream from the drum, the air circulation duct further defining a predetermined leakage port in fluid communication to permit air to pass between the recirculation loop and the interior volume of the cabinet surrounding the recirculation loop;

an air handler disposed along the air circulation duct in fluid communication between the drum air outlet and the drum air inlet; and a heat exchange section disposed along the air circulation duct in thermal communication with air within the recirculation loop, wherein the predetermined leakage port is a first predetermined leakage port defined along the recirculation loop downstream from the heat exchange section and upstream from the drum air inlet.

2. The dryer appliance of claim 1, further comprising a sealed refrigeration circuit mounted within the interior volume of the cabinet, the sealed refrigeration circuit comprising a compressor to motivate a refrigerant therethrough, an evaporator to evaporate the refrigerant before the compressor, and a condenser to condense the refrigerant from the compressor, wherein the heat exchange section includes the condenser along the air circulation duct to exhaust heat to air within the recirculation loop, and wherein an air entrance is defined along the recirculation loop between the evaporator and the condenser to permit air thereto.

3. The dryer appliance of claim 1, wherein a second predetermined leakage port is defined along the recirculation loop between the air handler and the heat exchange section.

4. The dryer appliance of claim 1, further comprising a ventilation duct extending from the air circulation duct and through the cabinet in fluid communication with the recirculation loop.

5. The dryer appliance of claim 1, wherein the first predetermined leakage port defines a flow coefficient ratio between 5 and 20 based on a flow rate and a pressure difference thereacross.

6. The dryer appliance of claim 1, further comprising a leakage valve in fluid communication with the first predetermined leakage port to selectively limit a flow of air between the air recirculation loop and the interior volume.

7. The dryer appliance of claim 6, further comprising a controller operably coupled to the leakage valve, wherein the controller is configured to direct air restriction through the leakage valve.

8. The dryer appliance of claim 7, further comprising a temperature sensor mounted along the recirculation loop and operably coupled to the controller, wherein the controller is configured to direct air restriction through the leakage valve based on a temperature signal received from the temperature sensor.

9. The dryer appliance of claim 6, further comprising a passive temperature switch mounted along the recirculation loop and operably coupled to the leakage valve, wherein the passive temperature switch is configured to selectively direct air restriction through the leakage valve.

10. A dryer appliance comprising:

a cabinet defining an interior volume;

a drum rotatably mounted within the interior volume of the cabinet, the drum defining a space for receipt of clothes for drying;

an air circulation duct defining a recirculation loop with the drum, the air circulation duct defining a drum air inlet upstream from the drum and a drum air outlet downstream from the drum, the air circulation duct further defining a predetermined leakage port in fluid communication to permit air to pass between the recirculation loop and the interior volume of the cabinet surrounding the recirculation loop;

an air handler disposed along the air circulation duct in fluid communication between the drum air outlet and the drum air inlet to generate a negative pressure within the drum;

a heat exchange section disposed along the air circulation duct in thermal communication with air within the recirculation loop; and a sealed refrigeration circuit mounted within the interior volume of the cabinet, the sealed refrigeration circuit comprising a compressor to motivate a refrigerant therethrough, and a condenser to condense the refrigerant from the compressor, wherein the heat exchange section includes the condenser along the air circulation duct to transfer heat to air within the recirculation loop, wherein the predetermined leakage port is a first predetermined leakage port defined along the recirculation loop downstream from the air handler and upstream from the condenser.

11. The dryer appliance of claim 10, wherein a second predetermined leakage port is defined along the recirculation loop between the air handler and the heat exchange section.

12. The dryer appliance of claim 10, further comprising a ventilation duct extending from the air circulation duct and through the cabinet in fluid communication with the recirculation loop.

13. The dryer appliance of claim 10, wherein the first predetermined leakage port defines a flow coefficient ratio between 5 and 20 based on a flow rate and a pressure difference thereacross.

14. The dryer appliance of claim 10, further comprising a leakage valve in fluid communication with the first predetermined leakage port to selectively limit a flow of air between the air recirculation loop and the interior volume.

15. The dryer appliance of claim 14, further comprising:

a temperature sensor mounted along the recirculation loop; and a controller operably coupled to the leakage valve and the temperature sensor, wherein the controller is configured to direct air restriction through the leakage valve based on a temperature signal received from the temperature sensor.

16. The dryer appliance of claim 14, further comprising a passive temperature switch mounted along the recirculation loop and operably coupled to the leakage valve, wherein the passive temperature switch is configured to selectively direct air restriction through the leakage valve.

17. The dryer appliance of claim 10, further comprising an evaporator to evaporate the refrigerant before the compressor, wherein the first predetermined leakage port is defined along the recirculation loop between the evaporator and the condenser.

18. A dryer appliance comprising:

a cabinet defining an interior volume;

a drum rotatable mounted within the interior volume of the cabin the drum defining a space for receipt of clothes for drying;

an air circulation duct defining a recirculation loop with the drum, the air circulation duct defining a drum air inlet upstream from the drum and a drum air outlet downstream from the drum, the air circulation duct further defining a predetermined leakage port in fluid communication to permit air to pass between the recirculation loop and the interior volume of the cabinet surrounding the recirculation loop;

an air handler disposed along the air circulation duct in fluid communication between the drum air outlet and the drum air inlet; and a heat exchange section disposed along the air circulation duct in thermal communication with air within the recirculation loop, wherein the predetermined leakage port defines a flow coefficient ratio between 5 and 20 based on a flow rate and a pressure difference thereacross.

* * * * *